United States Patent [19]

Timari

[11] Patent Number: 4,555,973

[45] Date of Patent: Dec. 3, 1985

[54] AUTOMATIC HAND FIREARM OPERATING AND SAFETY HANDLE

[76] Inventor: Jali Timari, Hatanpäänvaltatie 32, SF-33100 Tampere 10, Finland

[21] Appl. No.: 551,995

[22] PCT Filed: Feb. 25, 1983

[86] PCT No.: PCT/FI83/00017

§ 371 Date: Oct. 24, 1983

§ 102(e) Date: Oct. 24, 1983

[87] PCT Pub. No.: WO83/02998

PCT Pub. Date: Sep. 1, 1983

[30] Foreign Application Priority Data

Feb. 26, 1982 [FI] Finland ..... 820713

[51] Int. Cl.[4] ..... F41C 7/00

[52] U.S. Cl. ..... 89/148; 89/1.4

[58] Field of Search ..... 89/1 K, 1 N, 125, 148, 89/154, 142, 27 A, 27 D, 168, 187 R, 194, 196, 197; 42/1 R, 7, 72, 70 R, 75, 71 R, 71 P

[56] References Cited

U.S. PATENT DOCUMENTS

| | | | |
|---|---|---|---|
| 1,460,415 | 7/1923 | Gorton | 89/1 K |
| 1,911,859 | 5/1933 | Frommer | 89/148 |
| 2,056,577 | 10/1936 | Kehne | 89/1 K |
| 2,480,328 | 10/1940 | Johnston | 42/70 R |
| 2,547,180 | 4/1951 | Taylor | 42/72 |
| 2,679,123 | 5/1954 | Williams | 42/75 |
| 3,906,833 | 9/1975 | Orozco | 89/196 |
| 4,176,584 | 12/1979 | Thomas, Jr. | 89/148 |
| 4,271,623 | 6/1981 | Beretta | 42/72 |

FOREIGN PATENT DOCUMENTS

| | | | |
|---|---|---|---|
| 37598 | 3/1981 | European Pat. Off. | 89/1 K |
| 972985 | 10/1959 | Fed. Rep. of Germany | 89/1 K |
| 488875 | 1/1954 | Italy | 42/72 |

*Primary Examiner*—Stephen C. Bentley

*Attorney, Agent, or Firm*—Andrus, Sceales, Starke & Sawall

[57] ABSTRACT

The invention concerns an automatic hand firearm with mass obturation, comprising a body (1) with handle (2), a barrel (3) joined to the body, a slide (4) with guide (5) and return spring (6), a cocking and firing mechanism (7) and an operating handle (8) for cocking the slide. The object is to provide a construction where the slide can be made safe in the forward and, if desired, the rearward position. As taught by the invention, the operating handle (8) is attached to the body (1) with the aid of a slide member (9), said slide member and operating handle being movable in the direction of the barrel and the slide member cooperating with the slide (4) so that the slide can be pulled into the cocked rear position by the operating handle and the slide can be put on safety in the cocked rear position and/or in the uncocked forward position by the aid of the operating handle and of a safety member (10) connected thereto. The operating handle (8) may be provided with a locking member (11) for locking the operating handle in the forward position.

4 Claims, 6 Drawing Figures

AUTOMATIC HAND FIREARM OPERATING AND SAFETY HANDLE

The present invention concerna an automatic hand firearm with mass obturation.

BACKGROUND OF THE INVENTION

The problem encumbering automatic hand firearms with mass obturation is the lack of safety in the forward position of the slide. As a consequence, when the firearm is forcefully knocked on the ground, butt first, the slide will move to the rear and by action of the spring forward again, at the same time feeding a cartridge into the barrel and firing the round. Shots fired accidentally in this way have in certain instances caused great causalties.

SUMMARY OF THE INVENTION

The object of the present invention is to eliminate the drawback mentioned and to provide an automatic hand firearm where the slide can be made safe also in the forward position so that accidental movement of the slide into its rear position and loading of the gun is prevented. A further object of the invention is to provide an automatic hand firearm where unintentional forward and/or rearward movement of the slide is prevented. It is a further object of the invention to provide an automatic hand firearm where the slide may, if desired, be slowly admitted to go into its forward position so that no firing of the round takes place. Furthermore, it is an object of the invention to provide an automatic hand firearm which is provided, in addition to the conventional handle, with a particular operating handle, placed to advantage at the muzzle end of the barrel, to facilitate aiming when giving continuous fire.

Regarding the features which are characteristic of the invention, reference is made to the claims section.

The invention is based on a construction in which the operating handle has been pivoted to the body with the aid of a slide member to be turnable from its transporting position into the shooting position and to be movable in the longitudinal direction of the gun, that is in the direction parallel to the barrel. The slide member cooperates with the slide so that the slide can be cocked with the slide member and advantageously allowed to go into the forward position slowly under control by the slide member, without firing the gun. Moreover, the operating handle has been provided with at least one safety member for putting the slide on safety and for locking it in the cocked rear position and/or in the uncocked forward position with the aid of the operating handle.

DESCRIPTION OF THE ILLUSTRATED EMBODIMENT

Figure 1:
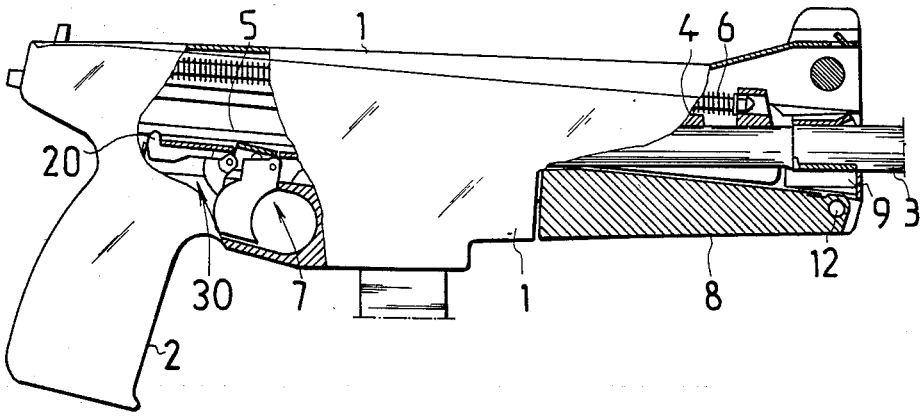
FIG. 1 presents in elevational view and partly sectioned, a hand firearm according to the invention.

In FIG. 1 is seen an automatic hand firearm with mass obturation, i.e. the recoil force caused by firing the firearm is utilized to move the mass of a sliding mechanism into its rear firing position, comprising a gun body 1 with handle 2 and barrel 3. The slide 4 has been disposed to be movable substantially parallel to the barrel, carried by the guide groove 5, and it has been provided with a return spring 6. The gun furthermore comprises a cocking mechanism 30 and firing mechanism 7 and an operating handle 8 for cocking the slide. When using the firearm, the slide 4 is cocked in its rear position, where it is held by the cocking step 20, removable by means of the firing mechanism 7. When the gun is fired with the aid of the firing mechanism 7, the slide is enabled to move forward, pushed by the force of the spring 6, whereat in its forward rush it takes a cartridge from the magazine, feeds it into the barrel and fires it. The recoil force from the round moves the slide into its rear position again.

As taught by the invention, the operating handle 8 has been joined to the body 1 by the aid of a particular slide member 9, this slide member being carried in the body of the gun, movably substantially in the direction of the barrel. The slide member is connected slidably within the body by the known means, E.g. on the body has been established two support means (not shown), on which the slide member has been slidably mounted. It is thus understood that the slide member 9 and the operating handle 8 are movable in the direction of the barrel 3. The slide member 9 cooperates with the slide 4 in such manner that the slide can be pulled into its cocked rear position by pulling the operating handle and therewith the slide member, and thus the slide, into the rear position. The operating handle 8 has been secured with a safety member 10 (FIGS. 2–4), which has been so disposed that the slide 4 can be put on saftey in the cocked rear position or the uncocked forward position with the aid of the operating handle 8.

Figure 2:
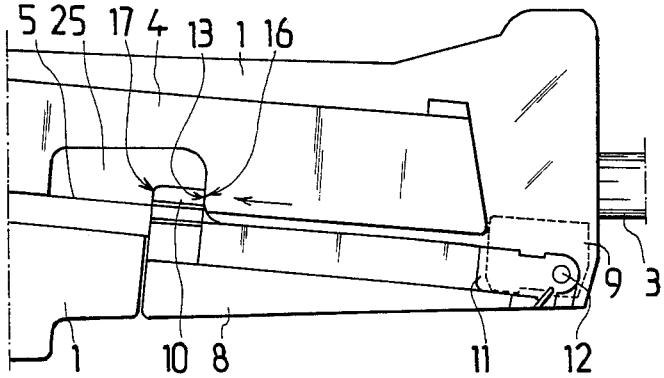
FIG. 2 presents in elevational view and partly opened, the forward position with the aid of the operating handle.

FIG. 2 reveals the detailed construction of the operating handle 8. In the embodiment depicted, the safety member 10 consists of a shoulder comprising the bracing face of the barrel's 3 muzzle, that is the forward bracing face, 16 and the opposite, that is the rearward bracing face 17. On the slide 4 has been established an engagement face 13 cooperating with said forward bracing face 16, this face 13 having been so arranged that the slide is braced against said bracing face by mediation of said engagement face when it is substantially in its forward position and the bracing face prevents the rearward movement of the slide. In the embodiment depicted, the operating handle 8 is pivotally connected to the slide member 9 by means of pin 12 to be turnable in a plane parallel to the barrel 3, and the safety member is constituted by the shoulder established on the lower end of the operating handle. In FIG. 2, the operating handle 8 has been pushed rearward and up, to parallel the barrel, so that the safety member 10 is pushed into a mating notch 25 formed on the slide, while the said forward bracing face pushes against the engagement face 13 and thus locks the slide in its forward position.

Figure 4:
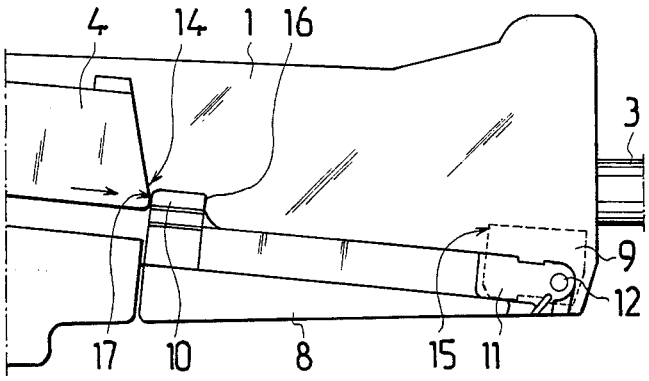
FIG. 4 presents in elevational view and partly opened, the same gun as FIGS. 1–3, with the slide put on safety in the cocked position with the aid of the operating handle.

In FIG. 4, the slide 4 is in its rear position, that is in cocked position, held for instance by the cocking rest 20 (see FIG. 1). The operating handle 8 has been turned rearward and upward to parallel the barrel 3, against the barrel, so that the safety member 10 has been pushed into the path of movement of the slide 4, and the slide rests by its latter bracing face 14 against the rearward, latter bracing face 17 of the saftey member, whereby the safety member prevents the pushing forward of the slide 4 even if the trigger were pressed. The operating handle has been provided with a locking member, for instance a spring latch, for locking the handle in the position shown in FIGS. 2 and 4.

Figure 3:
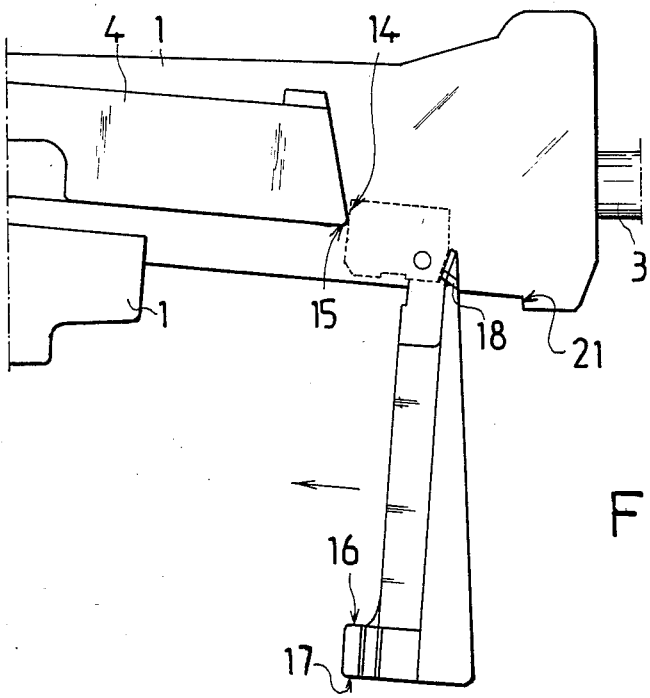
FIG. 3 presents in elevational view and partly opened, the same gun as FIGS. 1 and 2, when the slide is being cocked with the aid of the operating handle.
Figure 5:
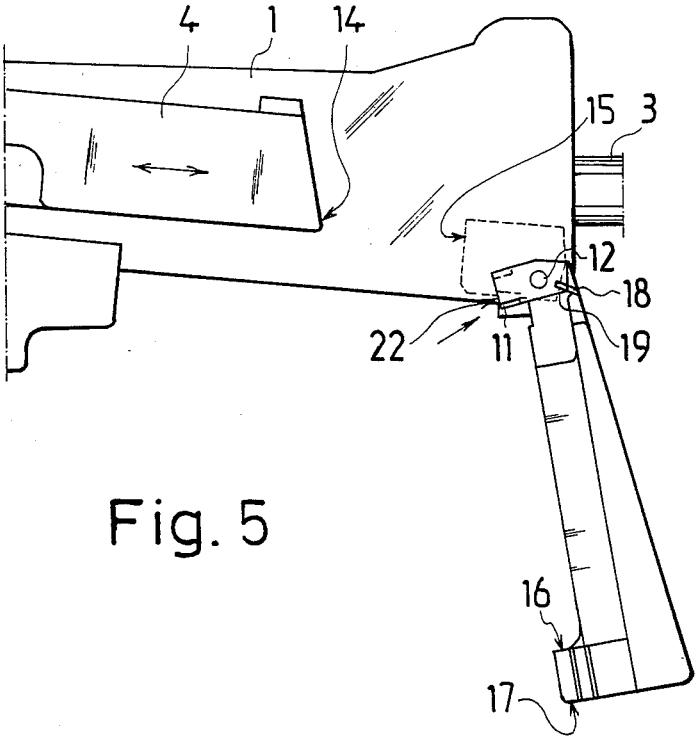
FIG. 5 presents the same gun as FIGS. 1–4 when giving continuous fire and with the operating handle in respective position and FIG. 6 presents in elevational view and partly sectioned, another hand firearm according to the invention, when giving continuous fire and with the operating handle in respective position.

FIG. 3 illustrates how the slide is cocked with the aid of the operating handle 8. The slide member 9, which has been carried in the body 1 to be movable in the direction of the barrel 3, has been pulled backward by the operating handle 8, the latter being connected to the slide member 9. The slide member 9 has been provided with a bracing face 15, disposed on the path of motion of the slide 4 so that the engagement face 14 of the slide rests against the slide member by mediation of said bracing face. When the operating handle 8 is pulled further rearward, the slide member will move rearward, thereby moving the slide further rearward and into the locked rear position, to be held by the cocking rest 20 (FIG. 1). The slide member may thereafter be pushed into the forward position with the aid of the handle 8. When shooting with the gun, the slide member 9 is pushed into the forward position and turned forward as shown in FIG. 5, whereby the locking member 11, that is a ferrule pivoted to the slide member by means of an axle pin 12, turns along with the operating handle and the locking shoulder 22 enters behind a shoulder formed on the body, preventing the rearward movement of the slide member, and thus of the operating handle. The locking is released by turning the operating handle 8 rearward, causing the ferrule to be braced against the handle and to turn therewith, opening the locking. In FIGS. 3 and 5, the operating handle has been locked to the ferrule, that is to the locking member 11, with the aid of a spring-loaded pin 18, which enters a groove 19 provided in the ferrule. The shoulder 21 established on the body 1 and in support of which the slide member 9 can be locked with the aid of the locking member 11, is seen in FIG. 3.

It is possible, if desired, to let the slide 4 slip forward from its forward position, in controlled manner, carried by the slide member 9, by moving the slide member into the rear position so that the slide rests against the slide member by mediation of the bracing surface 15 and the engagement face 14, whereafter the slide is allowed to move forward by pressing the trigger and letting the slide member move forward into its forward position while restraining this movement by the handle 8.

Figure 6:
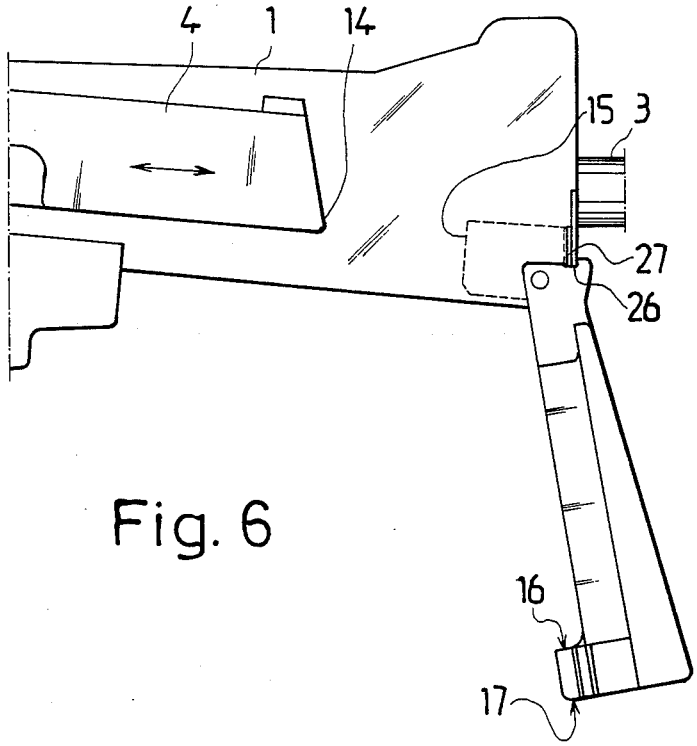

In the embodiment depicted in FIG. 6, the locking member 11 has been formed of a groove-like depression 26 made on the end of the operating handle. When the handle is turned into its forward position, the part 27 of the gun's body enters the recess 26 and locks the handle in the firing position when the handle is held in the forward position.

I claim:

1. An automatic hand firearm with mass obturation, comprising:

a body incuding a handle, a barrel;

a slide mounted for reciprocal movement between a rear cocked position and a forward position within said body;

cocking means for holding said slide in said cocked position until released by a fire mechanism;

a slide member disposed forward of an engageable with said slide, said slide member being slidably mounted within the body substantially in the direction of said barrel;

an operating handle pivotally connected to said slide member and pivotable from a stored position to a firing and support position substantially perpendicular to the longitudinal axis of said barrel, operating handle movable rearwardly with said slide member, said slide having a forward facing engaging face and a rearward facing engaging face, said handle having a rear facing bracing face disposed to be engaged by said forward facing engaging face when the slide is in the cocked position and said handle is in the stored position, said handle also having a forward facing bracing face to be engaged by said rear facing engaging face when the slide is in the uncocked position and said handle is in the stored position, said slide member disposed to engage said forward facing engaging face on rearward movement of said slide to draw said slide rearwardly into said cocked position.

2. The hand firearm defined in claim 1, wherein said operating handle includes a locking member for locking the operating handle in said firing and supporting position.

3. The hand firearm defined in claim 1, wherein said slide includes a notch, said rearwardly facing engaging face bordering said notch and the forward end of said slide constituting said forward engaging face.

4. The hand firearm defined in claim 2, wherein said locking member includes a ferrule pivoted to said slide member and includes a locking shoulder, said ferrule being disposed to turn along with said operating handle when said operating handle is pivoted into said firing and supporting position so that said locking shoulder locks said ferrule and said operating handle in said firing position, said locking being releasable by turning said operating handle rearward, whereby said ferrule, bracing against said handle, turns along with it and releases the locking.

* * * * *

UNITED STATES PATENT AND TRADEMARK OFFICE

CERTIFICATE OF CORRECTION

PATENT NO. : 4,555,973

DATED : December 3, 1985

INVENTOR(S) : JALI TIMARI

It is certified that error appears in the above-identified patent and that said Letters Patent is hereby corrected as shown below:

Col. 1, Line 5, Cancel "concerna" and substitute therefor ---concerns---; Col. 4, Line 11, CLAIM 1, Cancel "incuding" and substitute therefor ---including---; Col. 4, line 14, CLAIM 1, After "forward" insert ---uncocked---; Col. 4, line 18, CLAIM 1, Cancel "an" and substitute therefor ---and---; Col. 4, line 24, CLAIM 1, Cancel "support" and substitute therefor ---supporting---; Col. 4, line 25, CLAIM 1, Before "operating" insert ---said---; Col. 4, line 47, CLAIM 3, After "forward" insert ---facing---.

Signed and Sealed this

*Sixth* Day of *May 1986*

[SEAL]

*Attest:*

DONALD J. QUIGG

*Attesting Officer*

*Commissioner of Patents and Trademarks*